US005333681A

United States Patent [19]

Jullien et al.

[11] Patent Number: 5,333,681

[45] Date of Patent: Aug. 2, 1994

[54] HEAT EXCHANGER OF THE PLATE TYPE

[75] Inventors: Claude Jullien, Puteaux; Yves Couillard, Fourqueux, both of France

[73] Assignee: Packinox SA, Louveciennes, France

[21] Appl. No.: 937,830

[22] PCT Filed: Dec. 20, 1991

[86] PCT No.: PCT/FR91/01046

§ 371 Date: Oct. 20, 1992

§ 102(e) Date: Oct. 20, 1992

[87] PCT Pub. No.: WO92/11500

PCT Pub. Date: Jul. 9, 1992

[30] Foreign Application Priority Data

Dec. 21, 1990 [FR] France ..... 90 16060

[51] Int. Cl.[5] ..... F28F 7/00

[52] U.S. Cl. ..... 165/82; 168/145; 168/160

[58] Field of Search ..... 165/81, 82, 165, 160, 165/145

[56] References Cited

U.S. PATENT DOCUMENTS

| | | | |
|---|---|---|---|
| 3,596,638 | 8/1971 | Michel | 165/82 |
| 3,930,537 | 1/1976 | Wolowodiuk | 165/160 |
| 4,267,882 | 5/1981 | Gralton | 165/145 |
| 4,441,549 | 4/1984 | Vasiliev et al. | 165/165 |
| 4,548,260 | 10/1985 | Stachura | 165/160 |
| 4,807,698 | 2/1989 | Köhnen et al. | 165/145 |

FOREIGN PATENT DOCUMENTS

| | | | |
|---|---|---|---|
| 0150225 | 8/1985 | European Pat. Off. . | |
| 911373 | 7/1946 | France . | |
| 2288287 | 5/1976 | France . | |
| 2647198 | 11/1990 | France . | |
| 626477 | 10/1961 | Italy | 165/81 |
| 173394 | 10/1983 | Japan | 165/81 |
| 206380 | 9/1987 | Japan | 165/165 |

*Primary Examiner*—John Rivell
*Assistant Examiner*—L. R. Leo
*Attorney, Agent, or Firm*—Millen, White, Zelano & Branigan

[57] ABSTRACT

The invention relates to a plate-type heat exchanger comprising a stack (1) of plates (2) for heat exchange between fluids which circulate between each other, said stack being placed within a pressure vessel (3). The invention is characterized in that it comprises rigid means for suspension of said stack (1) from said vessel (3) at the level of at least a first collector circuit which comprises a first connecting box (21; 23) at the upper end of the stack (1) and guides a first of said fluids between said end and the exterior of the vessel (3).

12 Claims, 3 Drawing Sheets

HEAT EXCHANGER OF THE PLATE TYPE

The present invention is concerned with a design concept of a plate-type heat exchanger. Generally speaking, plate exchangers differ from shell-and-tube exchangers in that the fluids in a heat-exchange condition flow longitudinally on each side of plates placed in juxtaposed and parallel relation.

As described, for example, in French patent No. 2 471 569 or in French patent Application No. 88 13883, heat exchangers of this type have a stack of parallel flat plates made up of thin corrugated sheets which are mostly of stainless steel. By means of their corrugated surfaces, said sheets are in contact with each other and serve to establish the circulation of the fluids from one end of the heat exchanger to the other in the longitudinal direction (usually in countercurrent flow) while setting up turbulences, these turbulences being conducive to the heat exchanges which take place between the fluids through each plate. Along their longitudinal edges, the plates are welded to each other by means of small tongues or frames forming spacer members which maintain the spacing between two successive plates. The stack of plates is surrounded by two metallic sheets of relatively substantial thickness, thus transferring the weight of the stack to a support.

The thickness of the exchanger plates depends on whether or not it is necessary to endow the stack with mechanical strength by ensuring rigidity of the plates themselves.

In this type of heat exchanger, one encounters specific problems of operational safety and durability other than those for which a solution has been found in the case of tube-type exchangers, especially those in which the heat-exchange elements are mounted so as to form a bundle of parallel cylindrical tubes, the ends of which open through transverse plates to which they are welded.

To reconcile thermal expansion phenomena with mechanical stresses therefore demands radically different solutions. In particular, the high efficiency sought by the use of heat exchange elements consisting of thin metallic sheets of large size and especially of substantial length which are applied against each other by means of corrugations providing passageways for the circulating fluids is concomitant with low mechanical strength of these elements. At the same time, any connections between the stack of thin sheets and structural elements which have sufficient thickness to possess high mechanical strength give rise to differences in thermal inertia and hence to sensitivity to temperature variations.

In conventional designs of plate exchangers to which the invention is preferentially directed, the sheets of substantial thickness and mechanical strength which surround the stack of heat exchange plates serve to support the entire assembly within a vessel or shell which affords resistance to the pressure of fluids. Said sheets are rigidly fixed to the shell in the central portion of the heat exchanger by means of lateral coupling plates.

The need to use framing sheets of sufficient thickness to withstand all the mechanical stresses to which the stack is subjected and to transfer the stresses by means of brackets or other supports to the vessel itself gives rise to difficulties in regard to the connections with the thin sheets of the stack since the welded joints formed are sensitive to thermal phenomena. Furthermore, the stack exhibits a deplorable tendency to undergo a bending moment at the level of the longitudinal faces not equipped with thick support sheets in the median support zone.

While overcoming these disadvantages, the invention proposes a plate exchanger corresponding to a novel mode of assembly of the stack within its vessel which meets practical requirements more effectively than plate exchangers of the prior art, especially in regard to convenience of manufacture, costs and operational safety.

The invention is directed to a plate-type heat exchanger comprising a stack of plates for heat exchange between fluids which circulate between each other, said stack being placed within a pressure vessel, characterized in that it includes means for rigid suspension of said stack from said vessel at the level of at least a first collector circuit which comprises a first connecting box at the upper end of the stack and guides a first of said fluids between said end and the exterior of the vessel.

From now on, the suspension of the stack takes place in accordance with the invention at the level of the top collector of the exchanger, thus making it possible to limit the thickness of the metallic sheets surrounding the stack to a considerable extent insofar as they no longer have to withstand the suspension stresses of the entire assembly. This also prevents the appearance of forces which tend to separate these sheets in the lower portion of the stack.

In a first embodiment of the invention, said first collector circuit comprises a duct which constitutes the suspension means by virtue of the fact that it is rigidly connected to said connecting box so as to suspend this latter from a top shell cover which closes the vessel.

In a second embodiment, said suspension means comprise at least a first plate for providing a rigid coupling between the first connecting box and a shell which limits the vessel around the stack.

In this embodiment, advantageous use is made of the fact that the connecting box is formed by metallic sheets of greater thickness than the plates constituting the stack in order to use it for the suspension of this latter.

In accordance with secondary features of the invention which are common to the two embodiments of the suspension means:

The heat exchanger comprises in addition a second collector circuit which comprises a second connecting box at the upper end of said stack and guides a second of said fluids between said end and the exterior of said vessel.

Said connecting boxes at the upper end of the stack are constructed in the form of substantially semi-cylindrical boxes mounted axially one inside the other.

In the preferred applications of the invention, the fluid collector circuits as defined in the foregoing are designed and dimensioned as a function of the properties of the fluids which they are intended to convey. In preferred embodiments, said collector circuits are intended to receive respectively in the case of the inner collector a fluid to be withdrawn from the heat exchanger at a relatively low pressure and in the case of said outer collector to receive a fluid at a relatively high pressure close to the pressure of this fluid which fills the vessel as it is admitted into the heat exchanger. And in combination or not with the foregoing, they are advantageously intended to receive respectively fluids having temperatures closely related in value as is apparent from the efficiency characteristics of the apparatus.

In accordance with secondary features of the invention as applicable especially to the first embodiment of the suspension means:

Said first collector circuit constitutes an outer collector circuit in which is axially mounted said second collector circuit which constitutes an inner collector circuit; and that said first connecting box for the first fluid contains axially said second connecting box for the second fluid, suspension of the stack being ensured by the duct of the first outer collector which has the function of guiding the first fluid as it passes through the top shell cover which closes the vessel, said duct being coaxial with an inner duct of the second collector which has the function of guiding the second fluid as it passes through the top shell cover.

In this embodiment, the first fluid is the fluid at relatively high pressure and the second fluid is the fluid at relatively low pressure.

Said first collector circuit constitutes an inner collector circuit mounted axially within said second collector circuit which constitutes an outer collector circuit; and that said second connecting box for the second fluid contains axially said first connecting box for the first fluid, suspension of the stack being ensured by means of an outer duct having the function of guiding the second fluid as it passes through the top shell cover which closes the vessel, said outer duct being rigidly fixed on the one hand to the top shell cover and on the other hand to the duct of the inner collector which has the function of guiding the first fluid as it passes through the top shell cover.

In this alternative embodiment the first fluid is the fluid at relatively low pressure and the second fluid is the fluid at relatively high pressure.

In accordance with secondary characteristics of the invention as applicable especially to the second preferred embodiment of the suspension means:

said second collector circuit constitutes an inner collector circuit mounted axially within said first collector circuit which constitutes an outer collector circuit for the first fluid;

said suspension means comprise at least two coupling plates having approximately the shape of a half-disk each rigidly fixed along its straight edge to a flat face which constitutes one end of the semi-cylinder formed by the first outer connecting box;

said suspension means comprise at least two support plates having approximately the shape of a half-disk which are welded along their respective circular edge to the internal face of the shell which limits the vessel of the stack, said support plates being intended to receive the coupling plates which are joined to said first outer connecting box;

said collector circuits each include a duct having the function of guiding the fluid conveyed by said collectors as it passes through a top shell cover which closes the vessel, each duct being joined to a corresponding connecting box by means of a metallic bellows element which constitutes an expansion compensator;

each coupling plate has an oblong slot through which means are intended to be passed in order to attach said coupling plate to said support plate on which it rests and to permit adjustment of centering of the stack; said attachment means being preferably constituted by a nut-and-bolt assembly which passes through said oblong slot and through a circular hole formed in said support plate.

In accordance with other secondary features of the invention which are common to the two embodiments of the suspension means:

said collector circuits comprise respectively an outer duct and an inner duct constituted by coaxial cylindrical tubes and having the function of guiding the fluids as they pass through a top shell cover which closes the vessel;

said outer collector circuit has a lateral branch external to the vessel on said outer duct and said inner duct which passes axially through said outer duct is rigidly fixed in leak-tight manner to a cover which closes said outer duct;

said collector circuits are intended to receive respectively a first fluid which is to be withdrawn from the heat exchanger at relatively high pressure and which fills said vessel at its admission into the exchanger, and a second fluid at relatively low pressure;

said collector circuits are intended to receive respectively a first fluid at relatively low temperature in the heat exchange, and a second fluid at relatively high temperature.

In view of the fact that different materials are usually employed in the fabrication of the stack and in the fabrication of the vessel which encloses the stack, namely in particular a stainless steel for the heat-exchange plates and for the stack as a whole, and a chrome steel for the vessel, it is an advantage to construct each of the outer and inner ducts in the form of at least two tube sections welded end-to-end in the case of the first embodiment or by means of an expansion bellows in the case of the second preferred embodiment, an outer section adjacent to the vessel being formed of the same material as this latter and an inner section adjacent to the stack being formed of the same material as this latter. Furthermore, the inner section of the outer duct is preferably constituted over at least part of its length by two semi-cylindrical walls which are welded together along opposite generator-lines at the time of construction of the heat exchanger, after butt-jointing of the inner duct.

In the designs of this type, the pressure conditions which prevail on each side of the walls of each of the collector circuits advantageously lead to a mechanical arrangement whereby the stack is suspended from the inner collector circuit which has walls of relatively substantial thickness whilst the construction of the outer collector circuit makes use of relatively thin walls having a function of leak-tight closure and not of mechanical suspension.

In the bottom portion of the heat exchanger, at the end opposite to the above-mentioned suspension assembly, the collector circuits for the supply and withdrawal of fluids can be constructed in any manner which is conventional per se. In preferred modes of construction, provision is again made for a thermal expansion compensator in a collector circuit which connects fluid passages between plates at the center of the stack to the exterior of the exchanger through the vessel and, on the other hand, a direct supply of fluid at relatively high pressure within the vessel.

In a preferred embodiment, the heat exchanger in accordance with the invention is also provided with means for centering the heat exchange stack with respect to a cylindrical shell which limits the outer vessel, said means being also dimensioned so as to be capable of supporting the stack when it is not in operation and is in a horizontal longitudinal position.

The present invention offers appreciable advantages in the construction of plate exchangers and in regard to their operational safety.

In fact, the result thus achieved in particular with respect to the prior art is to dispense with the use of thick supporting sheets in the sides of the stack which are liable to constitute a thermal bridge between hot and cold portions, in particular in the event of thermal shock; to suppress any shearing stress in the weld wall which usually joins the plates to each other; to remove any stress arising from the weight of the stack in the heterogeneous welds forming a bond between the stack and the vessel, the materials of which are usually different; and not to interfere with the expansion of the stack during operation of the heat exchanger.

The invention will now be described in greater detail while bringing to light other secondary features as well as various advantages within the framework of particular examples of construction. Without intending to imply any limitation, reference will be made for the sake of clarity of the description to an application of the invention in which the plate exchanger is employed for carrying out heat exchange between the load and the effluent of a catalytic reforming unit in a petroleum refining installation.

This description is illustrated in FIGS. 1 to 4 of the accompanying drawings, in which.

Figure 4:
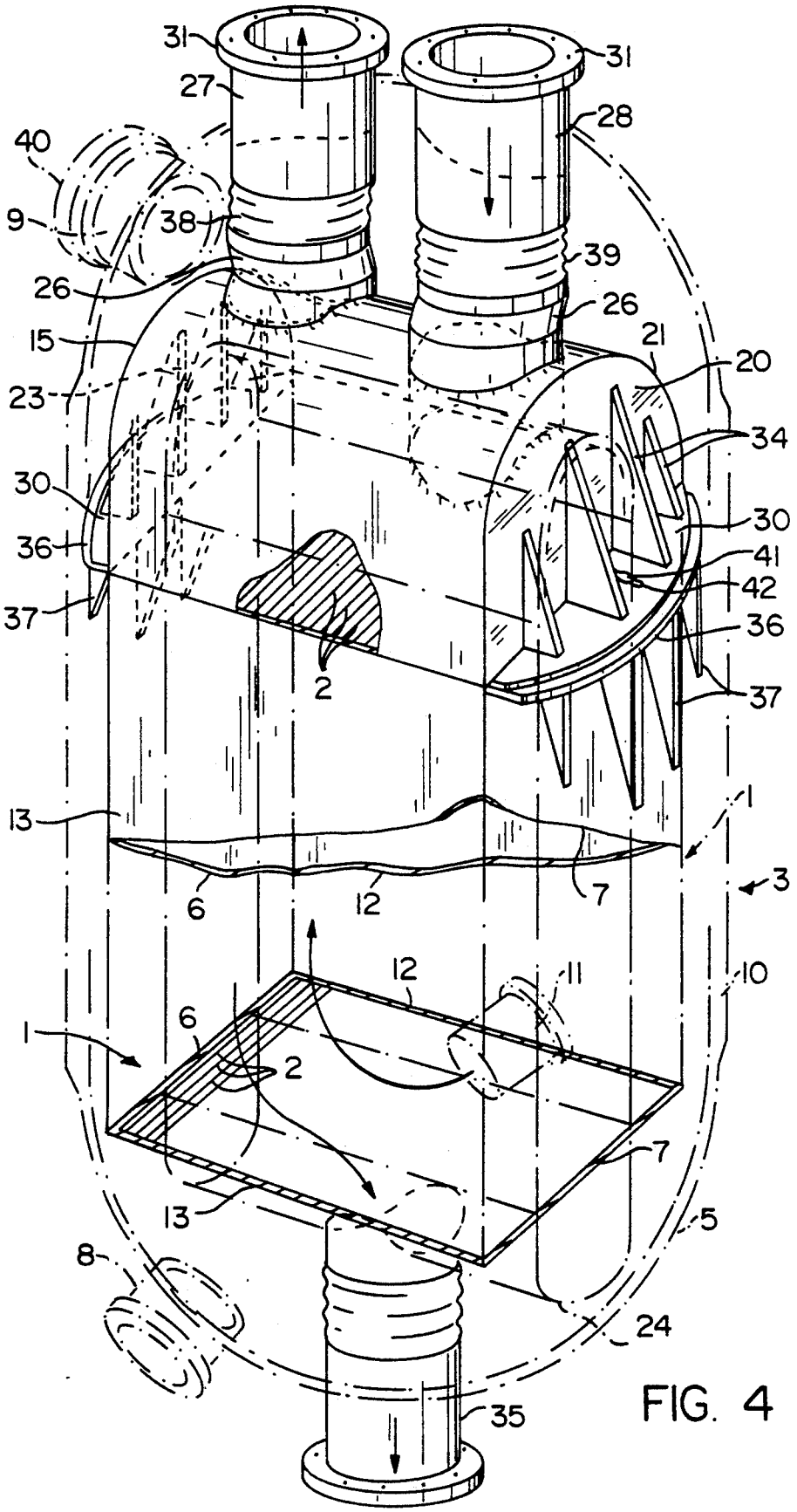

and FIG. 4 represents a view in perspective showing a second preferred embodiment of the invention.

In the drawings, the same elements have been designated by the same references for reasons of clarity.

In accordance with the figures, the heat exchanger in accordance with the invention essentially comprises a stack 1 of rectangular plates 2 for heat exchange between two fluids which pass longitudinally through the stack, and an outer vessel 3 which affords resistance to pressure of the fluids and encloses the stack. For the use which is contemplated in the particular case considered, the heat exchanger is intended to operate in a vertical longitudinal position, the fluid inlets and outlets being located at the two longitudinally opposite ends of the exchanger, at the top and bottom ends of the outer vessel. However, steps are taken to ensure that it can readily be transported in the horizontal position.

Two fluids circulate countercurrently in the longitudinal direction within the stack 1 through passages formed between two adjacent plates so that they are in a condition of heat exchange through a plate which separates them. A first of these fluids is the load consisting of naphtha and hydrogen and representing the relatively cold fluid which has to be preheated by the effluent within the heat exchanger. The second is formed by the relatively hot effluent. Moreover, the naphtha load arrives at the heat exchanger at a relatively higher pressure than the effluent and for this reason is admitted into the lower end of the exchanger so as to pass directly into the vessel 3, then fills this latter before passing through the stack.

The vessel or calandria 3 is essentially limited by a cylindrical shell 10 which surrounds the stack 1 over its entire length and by two hemispherical covers 4 and 5 which close the shell at the top and bottom ends of the heat exchanger. Taking into account the individual dimensions of the plates 2 and their number, the parallelepipedal stack 1 is contained axially within the calandria 3. The supply and withdrawal collection circuits which guide the two fluids between the stack and the exterior of the vessel pass through the calandria 3 as will be described hereinafter. The figures show in addition a nozzle 8 provided on the bottom shell cover 5 for admitting a recycling gas into the vessel, and a manhole 9 closed by a plate 40 which serves to gain entry to the vessel for mounting the internal elements of the heat exchanger and for maintenance of this latter.

Figure 2:
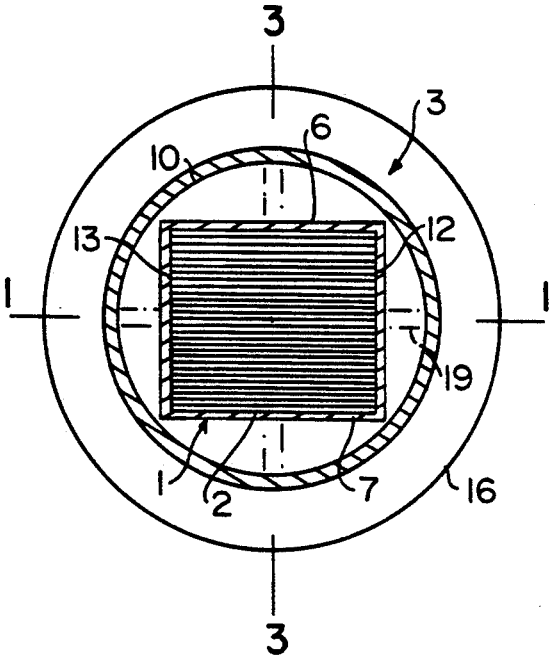
FIG. 2 is a schematic transverse sectional view of the heat exchanger in accordance with this first embodiment.

The fabrication of the heat-exchange stack proper is in accordance with the description given in French patent Application No. 88 13883 to which reference will be made in particular in regard to the construction of the plates 2 and to the design of the orifices for admission and discharge of the fluids at the level of the ends of the stack. FIG. 2, in which the edge faces of the plates 2 are apparent, is drawn to a scale which does not show how the plates are applied against each other by means of corrugations which have at the same time the function of providing passages between plates so as to guide the fluids towards the inlet or outlet collectors of the stack. These plates are manufactured with their corrugations by explosion-forming of thin sheets of stainless metal. They are stacked together so as to form the stack with interposition of small metal tongues welded to their edges and constituting spacer members which close-off the passages between plates on two opposite longitudinal faces 12 and 13 of the stack 1.

On its other two longitudinal faces, the stack is surrounded by two sheets 6 and 7 of substantial thickness, usually of stainless steel, so as to constitute a frame providing a mechanical support for the stack of plates. By way of example, the thin sheets constituting the plates 2 have a thickness of the order of 1 mm. The thick sheets 6 and 7 have a thickness of 3 to 5 mm whereas, in the prior art, a thickness of 10 mm was necessary by reason of the fact that these plates had to withstand all the mechanical stresses and to support the entire vertical stack within the calandria shell.

In accordance with the invention, the heat exchanger described does not have any really similar supporting member of sufficiently high strength and welded both to the sheets 6 and 7 and to the shell 10 so as to interconnect them in a rigid structure which affords resistance to the operating conditions. In contrast, provision is made instead for spacer members such as those which are shown at 18 and 19 and consisting, for example, of an openwork or star-shaped grid. They serve to support the stack 1 within the calandria shell 10, not when it is in the vertical position and in operation but only when it is in a horizontal position for transportation of the entire heat exchanger. During operation, these spacer members simply perform the function of centering members which retain the stack in the axis of the vessel 3.

As will be seen later, the stack is carried by fluid-collection circuits so as to be suspended from the vessel 3 at the top end of the heat exchanger. The complete exchanger assembly is supported by a base (not shown) on which the vessel 3 is supported by brackets 16 and 17 welded to the vessel at the level of the circular weld which forms a leak-tight joint between the bottom cover 5 and the shell 10.

Figure 1:
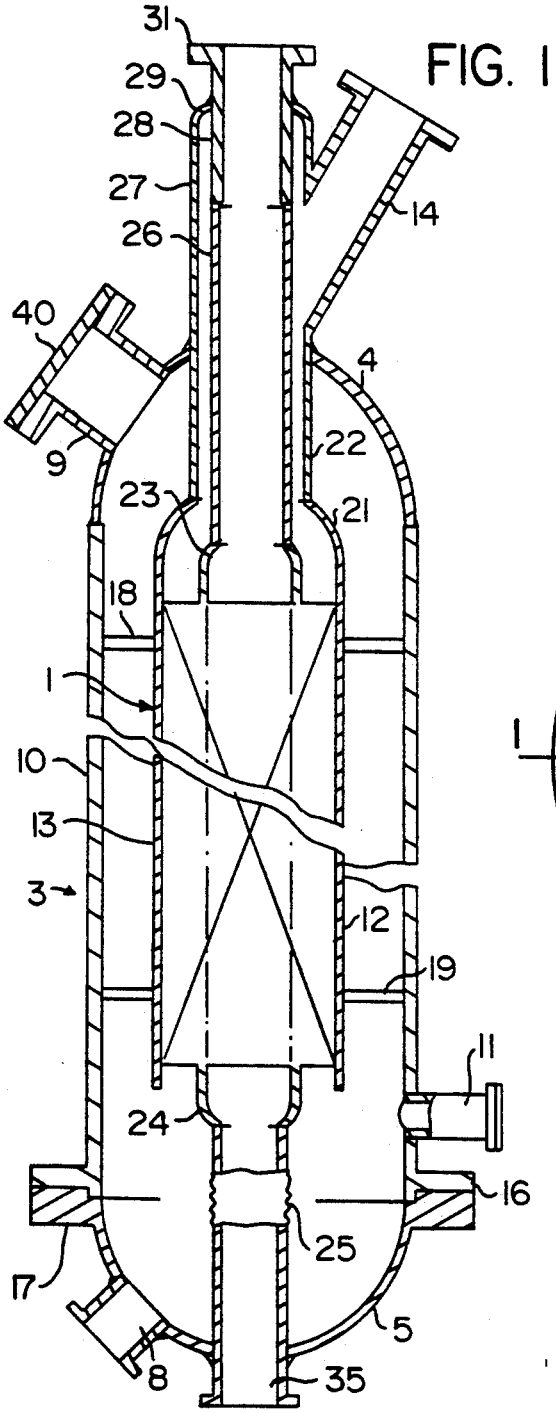
FIG. 1 is a schematic longitudinal sectional view of the heat exchanger taken along the diametral plane 1—1 of FIG. 2 in accordance with a first embodiment.
Figure 3:
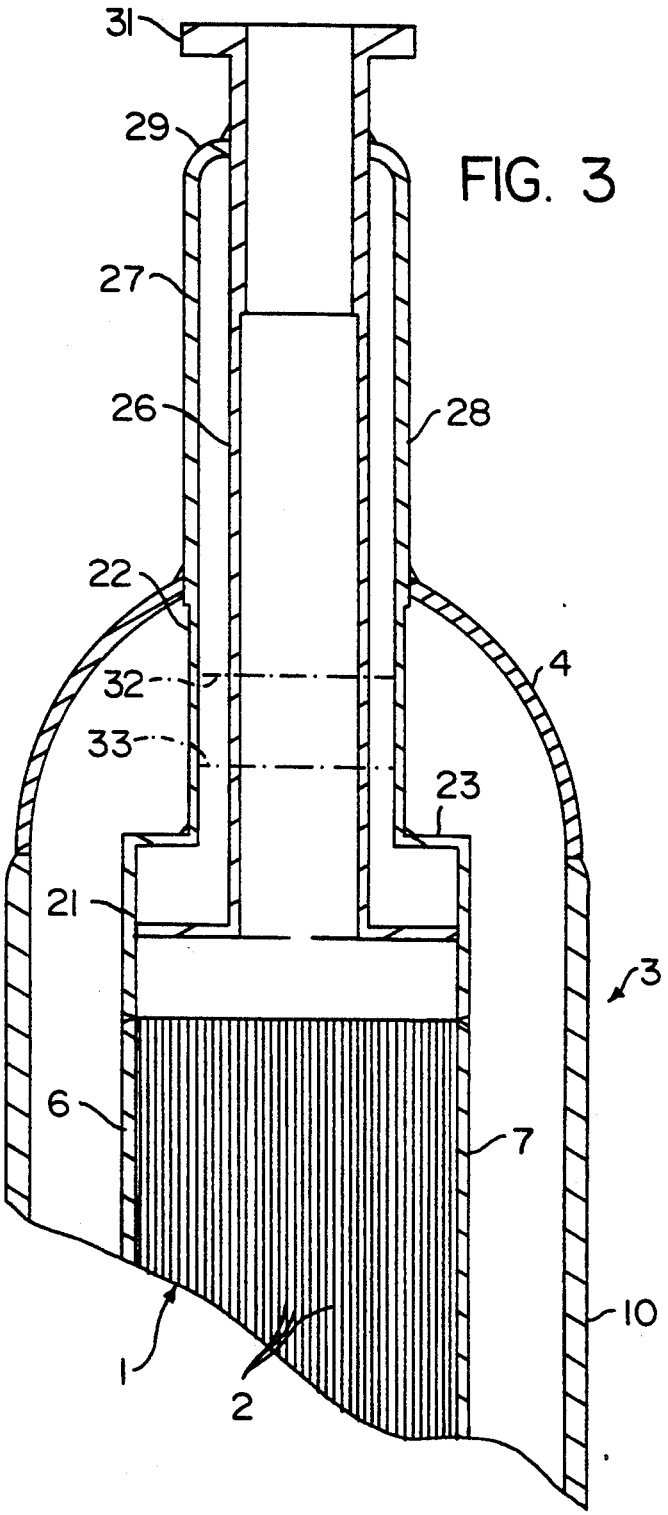
FIG. 3 represents schematically another longitudinal cross-section taken along 3—3 of FIG. 2 in which there is shown only an upper portion of the heat exchanger.

In the first embodiment illustrated in FIGS. 1 to 3, the load constituting the high-pressure fluid enters the lower end of the heat exchanger and passes directly into the vessel 3 via a nozzle 11. Said fluid fills said vessel and is recirculated by the passages between plates in the lower portion of the stack. At the top end of the stack, it is discharged into a first collector comprising a first connecting box 21 of semi-cylindrical annular shape and connected to an outer duct 22. Said duct passes axially through the top shell cover 4 in leak-tight manner and opens externally of the heat exchanger by means of a lateral branch 14 oriented slantwise, the end of said branch being provided with a suitable flange for connecting it to piping which no longer forms part of the exchanger. The duct 22, the branch 14 and the box 21 form together what is considered here as constituting an outer collector circuit for supplying the heat exchanger with the load of naphtha.

The effluent constituting the fluid at relatively low pressure enters the passages between plates at the upper end of the stack. It passes out of the stack at the lower end via a semi-cylindrical bottom connecting box 24 towards an axial duct 35 which completes an effluent extraction collector circuit by passing through the bottom shell cover 5. A second similar top connecting box 23 is welded to the stack at its upper end so as to ensure supply of the stack with effluent from an inner axial duct 26 which guides the effluent as it flows through the top shell cover 4 and constitutes an inner collector circuit.

As is apparent from FIG. 1, the duct 35 of the effluent extraction collector circuit located in the bottom portion of the heat exchanger is interrupted by a heat expansion compensator consisting in this case of a metallic bellows element 25. In this particular feature, said duct is similar to those of conventional plate exchangers which are suspended across the stack itself except for the fact that the nominal properties of the bellows element are calculated differently.

On the other hand, the design is totally different in the upper portion of the heat exchanger as is apparent from FIGS. 1 and 2. The inner effluent collector circuit comprising the second upper connecting box 23 and the inner duct 26 is placed axially within the load-supply outer collector circuit at the level of the first upper connecting box 21 and of the outer axial duct 22. There is thus formed a rigid assembly for the suspension of the stack 1 from the vessel 3 by means of its upper end whilst the effluent collector circuit or inner circuit is rigidly fixed to the load collector circuit or outer circuit which is in turn rigidly fixed to the vessel 3. The rigid connections involved are formed in practice by welded joints which ensure fluid-tightness at the same time.

The connecting boxes and the sections of the outer duct 22 and of the inner duct 26 which are located within the vessel 3 beneath the top shell cover 4 are advantageously made of stainless steel as in the case of the elements of the stack itself. The thickness of their walls can be relatively small, namely by way of example 25 mm in the case of the inner collector and 4 to 6 mm in the case of the outer collector. The ducts also have so-called outer sections 27 and 28 respectively welded end-to-end to the corresponding inner sections which are internal to the vessel 3. Said ducts penetrate through the shell cover 4 at the level of said sections 27 and 28 with provision for a leak-tight welded joint. The outer-section walls are of greater thickness and are formed for example of chrome steel as in the case of the vessel walls. The section 28 of the inner collector passes through a cover 29 which closes the outer collector beyond the branch 14 and terminates in an external coupling flange 31.

The design of the heat exchanger in accordance with the invention and involving this rigid suspension assembly having high mechanical strength leads to the fact that, during operation, the stresses resulting from differential thermal expansions and pressures of circulating fluids are exerted more in traction and compression than in flexion, in contrast to heat exchangers of the prior art. In this form of construction, these advantages are added to the reduction in the number of expansion bellows elements and to the simplification of manufacture together with the saving of material and labor costs thereby achieved.

In a variant of this first form of construction, the inner collector with its associated connecting box ensures in practice that the stack is mechanically supported by the cover 29 which closes the outer collector. Although this is not apparent from the figures, the walls of the section of the outer collector which is located inside the vessel 3 in this case have a thickness which is substantially smaller than that of the walls of the inner collector.

In order to facilitate the assembly of the elements of the heat exchanger during fabrication and in particular the welding of the collector circuits to the upper end of the stack by gaining access through the manhole 9 of the vessel 3, the inner section of the duct 22 is constituted over part of its length, between the transverse lines 32 and 33, by two semi-cylindrical connecting members which are welded in situ so as to close the corresponding circuit. The location of the zone in which two sections of different metallic materials are welded to the ducts of the inner and outer collector circuits can be calculated with precision in each particular application, depending on the operating conditions which are contemplated. It will be observed that, in all cases, the temperature differences to which the walls of the circuits are subjected are smaller than in the assemblies of the prior art. In fact, the intermediate annular space between the inner duct 26 and the outer duct 22 is occupied by the load which has already been preheated, between the hot effluent which enters the heat exchanger and the relatively cold load which fills the vessel. The stresses resulting from thermal expansions at the level of the collector circuits are therefore reduced.

Finally and in accordance with usual practice, the elements of the collector circuits which have been designated in the foregoing by the term "duct" are essentially constructed in the form of cylindrical tubes, especially at the level of the penetration of the vessel 3 to which they are welded in leak-tight manner.

There will be described below a preferred embodiment of the invention as illustrated in FIG. 4.

In regard to the constituent elements of the heat exchanger represented in this preferred embodiment which are common with the first embodiment, reference will be made to the description of this latter.

The suspension means illustrated in FIG. 4 comprise, on the two flat faces 15 and 20 which each constitute one end of the half-cylinder formed by the first outer connecting box 21, a coupling plate 30 which has approximately the shape of a half-disk so as to adapt itself to the curvature of the shell 10.

These two coupling plates 30 are welded along their straight edges and along the edges of right-angle brackets 34 to said flat faces 15 and 20. Said coupling plates are intended to rest on support plates 36 of similar shape which are in turn welded along their respective circular edges and the edges of rigidifying right-angle brackets 37 to the internal face of the shell 10.

Attachment of the coupling plates 30 to the support plates 36 is achieved by means of one or a number of nut-and-bolt assemblies 41 which extend through these latter. In order to facilitate centering of the stack, steps can advantageously be taken to ensure that the attachment means pass through the coupling plates 30 via oblong slots 42 which serve to adjust the position on the support plates 36. The oblong slots 42 of the two coupling plates 30 can be in directions at right angles to each other in order to permit adjustment in both directions.

Benefit is thus derived from the thickness of the metallic sheets constituting the outer connecting box 21 and from the flat character of its two end faces in order to ensure suspension of the stack 1 without having recourse to any increase in the thickness of the sheets surrounding the stack 1 in order to withstand supporting stresses.

This also makes it possible to avoid the appearance of forces having a tendency to cause opening-out of the stack under the action of suspension forces which were transferred to the sheets surrounding the stack in the prior art.

In the embodiment shown in FIG. 4, the ducts 22 and 26 which serve respectively to guide the first fluid from the outer connecting box 21 towards the exterior of the stack 3 and to guide the second fluid from the exterior of the vessel 3 towards the inner connecting box 23 are no longer coaxial.

In fact, the need for centering which exists by transferring the suspension forces to the inner or outer duct in the first embodiment is now no longer apparent. However, it is clearly possible to retain a form of construction with coaxial ducts for this second embodiment.

The sections of the ducts 22 and 26 which are located within the vessel 3 beneath the top shell cover 4 and which are joined to the connecting boxes 21 and 23 respectively are connected respectively to so-called outer sections 27 and 28 which pass through the shell cover 4 by means of metallic bellows elements 38 and 39 constituting thermal expansion compensators.

The sections 27 and 28 each terminate in a coupling flange 31.

The bottom portion of the heat exchanger is not modified with respect to the first embodiment.

The countercurrent circulation of the two heat-exchange fluids has been represented by arrows in FIG. 4: the first fluid is admitted through the nozzle 11 at the lower end of the heat exchanger and discharged at the top through the duct 22 and the second fluid is admitted into the exchanger through the duct 26 and discharged therefrom via the duct 35.

As in the previous instance, the heat exchanger is supported by a base on which the vessel 3 is supported by brackets (not shown) and the stack is supported by spacer members (not shown) when the heat exchanger is in a horizontal position for transportation.

Irrespective of the form of construction, the supporting stresses in the stack 1 are transferred to the vessel 3 via the connecting boxes which are preferably welded by joining the box edges constituting the longitudinal edges of the half-cylinders to the edges of the plates 2 which constitute the stack 1.

In order to ensure higher strength and rigidity of the stack, steps are taken to ensure that each plate 2 can be individually attached to the longitudinal edges of the inner connecting box 23 which are perpendicular to the plane in which the stack is formed.

Since the two connecting boxes 21 and 23 are rigidly joined to each other at their longitudinal ends by virtue of the fact that the flat faces are common to the two connecting boxes 21 and 23 (or if each box has its own end face, said faces are welded to each other), the suspension stresses applied to the two collectors are transferred according to the form of construction, either to at least one duct of a collector or to the coupling plates.

Naturally, the invention is not limited in any sense to the particular features which have been specified in the foregoing or to the details of the particular embodiment which has been chosen in order to illustrate the invention. All kinds of alternative arrangements can be made in the particular embodiment which has been described by way of example and in its constituent elements without thereby departing from the scope of the invention. This latter accordingly includes all means constituting technical equivalents of the means described as well as combinations thereof.

We claim:

1. A plate heat exchanger having an upper end and a lower end comprising a stack (1) of plates (2) for heat exchange between fluids which circulate longitudinally between each of two adjacent ones of said plates, said stack being within a pressure vessel (3), wherein said heat exchanger comprises: a rigid means for suspension of said stack by at least a first plate (30), the first plate providing a rigid coupling between a shell which defines the vessel (3), the first plate and a first connecting box (21; 23) at the upper end of the stack (1), said first connecting box (21; 23) constituting a first collector circuit which guides a first of said fluids circulating through said stack between said upper end of the stack (1) and the exterior of the vessel (3).

2. A plate exchanger according to claim 1, further comprising a second collector circuit which comprises a second connecting box (23; 21) at the upper end of said stack (1) and guides a second of said fluids between said end and the exterior of said vessel (3).

3. A plate exchanger according to claim 2, wherein said connecting boxes (23, 23) at the upper end of the stack (1) are designed in the from of substantially semi-cylindrical boxes mounted axially one inside the other.

4. A plate exchanger according to claim 2, wherein said second collector circuit constitutes an inner collector circuit (23, 26) mounted axially within said first collector circuit which constitutes an outer collector circuit (21, 26) for the first fluid.

5. A plate exchanger according to claim 2, wherein said collector circuits each include a duct (22; 26) guiding the fluid conveyed by said collectors as the fluid passes through a top shell cover (4) which closes the vessel (3), each duct (22, 26) being joined to a corresponding connecting box (21; 23) by means of a metallic bellows element (38; 39) which constitutes an expansion compensator.

6. A plate exchanger according to claim 2, wherein said collector circuits (21, 22; 23, 26) are adapted to receive respectively; a first fluid at relatively low temperature in the heat exchange, and a second fluid at relatively high temperature.

7. A plate exchanger according to claim 1, wherein the first connecting box is configured as a semi-cylinder and wherein said suspension means comprises at least two coupling plates (30) having approximately the shape of a half-disk, each rigidly fixed along its straight edge to a flat face (15; 20) which constitutes one end of the semi-cylinder formed by the first connecting box (21).

8. A plate exchanger according to claim 7, wherein said suspension means comprises at least two support plates (36) having approximately the shape of a half-disk which are welded along their respective circular edge to the internal face of the shell (10) which limits the vessel (3) of the stack (1), said support plates (36) being adapted to receive the coupling plates (30) which are joined to said first outer connecting box (21).

9. A plate exchanger according to claim 8, wherein each coupling plate (30) has an oblong slot (42) through which means (41) are adapted to be passed in order to attach said coupling plate to said support plate (36) on which it rests and to permit adjustment of centering of the stack (1).

10. A plate exchanger according to claim 9 wherein said attachment means comprises a nut and bolt assembly which passes through said oblong slot (42) and through a circular hole formed in said support plate (36).

11. A plate exchanger according to claim 2, wherein said collector circuits (21, 22; 23, 26) are adapted to receive respectively, a first fluid which is to be withdrawn from the heat exchanger at a high pressure and which fills said vessel (3) through inlet (11) into the exchanger, and a second fluid at a low pressure relative to said high pressure.

12. An exchanger according to claim 1, further comprising means (18, 19) for centering the heat exchange stack (1) with respect to a cylindrical shell (10) which limits the outer vessel (3), which are also dimensioned so as to be capable of supporting the stack (1) when it is not in operation and is in a horizontal longitudinal position.

* * * * *